US011685181B2

(12) United States Patent
Holcombe et al.

(10) Patent No.: US 11,685,181 B2
(45) **Date of Patent: *Jun. 27, 2023**

(54) MULTILAYER IDENTIFICATION PATCHES

(71) Applicant: Tier 1 Transnational LLC, Houston, TX (US)

(72) Inventors: Michael D. Holcombe, San Antonio, TX (US); Christopher J. Hart, Springfield, VA (US); Trey L. Stach, Austin, TX (US); Colleen P. Hart, Katy, TX (US)

(73) Assignee: Tier 1 Transnational LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/658,013

(22) Filed: Apr. 5, 2022

(65) Prior Publication Data

US 2022/0227161 A1 Jul. 21, 2022

Related U.S. Application Data

(63) Continuation-in-part of application No. 16/733,120, filed on Jan. 2, 2020, now Pat. No. 11,511,514.
(Continued)

(51) Int. Cl.
*B42D 25/42* (2014.01)
*B42D 25/378* (2014.01)

(52) U.S. Cl.
CPC ..... *B42D 25/42* (2014.10); *B42D 25/378* (2014.10)

(58) Field of Classification Search
CPC ..... A41D 29/00; B42D 25/378; B42D 25/42; G09F 13/16; G09F 21/023
See application file for complete search history.

(56) References Cited

U.S. PATENT DOCUMENTS 4,602,191 A 7/1986 Davila
5,544,062 A 8/1996 Johnston, Jr.
(Continued)

FOREIGN PATENT DOCUMENTS

WO 2007/126965 A2 11/2007
WO 2021/206376 A1 10/2021

OTHER PUBLICATIONS

Patch Panel; "Custom Patches"; webpage under menu item "Custom Patches"; accessed at "https://patchpanel.ca/pages/new-custom-patches" on Jan. 24, 2022 (3 pages).
(Continued)

*Primary Examiner* — Lawrence D Ferguson
(74) *Attorney, Agent, or Firm* — Trop, Pruner & Hu, P.C.

(57) ABSTRACT

A multilayer identification patch comprises a reflective layer and a design layer on top of the reflective layer. The design layer comprises an opaque body and at least one identification symbol void (ISV) to allow light to reflect from a portion of the reflective layer via the ISV. The opaque body of the design layer comprises multiple layers of cured photopolymer ink. The multiple layers of cured photopolymer ink comprise an opaque layer of colored photopolymer ink. In one embodiment, the multiple layers of cured photopolymer ink in the opaque body of the design layer further comprise a layer of clear photopolymer ink under the opaque layer of colored photopolymer ink. Other embodiments are described and claimed.

20 Claims, 6 Drawing Sheets

Related U.S. Application Data

(60) Provisional application No. 62/787,893, filed on Jan. 3, 2019.

(56) References Cited

U.S. PATENT DOCUMENTS

| | | | | |
|---|---|---|---|---|
| 6,191,200 | B1 | 2/2001 | Phillips | |
| 7,834,318 | B1 | 11/2010 | Cosimi | |
| 8,686,371 | B1 | 4/2014 | Bernath et al. | |
| 10,984,685 | B1 | 4/2021 | Kempisty | |
| 11,511,514 | B2 * | 11/2022 | Hart | B32B 7/08 |
| 2002/0039235 | A1 | 4/2002 | Condo et al. | |
| 2002/0160786 | A1 | 10/2002 | Rietzler et al. | |
| 2003/0053215 | A1 | 3/2003 | Condo et al. | |
| 2003/0147651 | A1 | 8/2003 | Roes et al. | |
| 2004/0085642 | A1 | 5/2004 | Condo et al. | |
| 2005/0186408 | A1 | 8/2005 | Condo et al. | |
| 2009/0046368 | A1 | 2/2009 | Banerjee et al. | |
| 2009/0097234 | A1 | 4/2009 | von Malm | |
| 2011/0267618 | A1 | 11/2011 | Caigoy | |
| 2012/0218653 | A1 | 8/2012 | Liu et al. | |
| 2015/0123767 | A1 | 5/2015 | Tolle | |
| 2017/0098148 | A1 | 4/2017 | Schmidt et al. | |
| 2018/0339251 | A1 * | 11/2018 | Li | B01D 39/18 |
| 2020/0215792 | A1 | 7/2020 | Hart et al. | |
| 2020/0363572 | A1 | 11/2020 | McCoy et al. | |

OTHER PUBLICATIONS

Patch Panel; webpage under menu item "PATCHES/CUSTOMIZABLE"; accessed at "https://patchpanel.ca/pages/new-custom-patches" on Jan. 24, 2022 (26 pages).
Patch Panel; webpage accessed at "https://patchpanel.ca/pages/custom-patches" on Jan. 25, 2022 (3 pages).
Patch Panel; "6"×2" ID Panel With HI VIS Flag"; webpage under menu item "PATCHES/CUSTOMIZABLE"; accessed at "https://patchpanel.ca/collections/customizable/products/6-x-2-id-panel-with-hi-vis-flag" on Jan. 24, 2022 (4 pages).
Daniel P.; online review of Patch Panel product at "https://patchpanel.ca/collections/customizable/products/4-x-1-custom-name-tape"; dated Aug. 3, 2018; accessed on Jan. 21, 2022 (1 page).
Larry W.; online review of Patch Panel product at "https://patchpanel.ca/collections/flags/products/micro-united-states-flag-hiviz"; dated Feb. 27, 2019; accessed on Jan. 24, 2022 (1 page).
Taylor L.; online review of Patch Panel product at "https://patchpanel.ca/collections/customizable/products/4-x-1-custom-name-tape"; dated Jul. 10, 2018; accessed on Jan. 21, 2022; 1 page.
Daniel M.; online review of Patch Panel product at https://patchpanel.ca/collections/customizable/products/4-x-1-custom-name-tape; dated Sep. 18, 2019; accessed on Jan. 24, 2022; 1 page.
EPEA Internationale Umweltforschung GmbH; "Cradle to Cradle Perspective on UV Printing, especially UV / LED"; 2017; 7 pages.
Wikipedia; "Photopolymer"; Jan. 28, 2022; 10 pages.
Geoff Ziezulewicz; "This Navy officer's name tag invention is now available for purchase"; Navy Times; Jan. 1, 2022; 7 pages.
Geoff Ziezulewicz; "Meet the sailor who wants to make your coverall nametag look less crappy"; Navy Times; May 14, 2021; 7 pages.

* cited by examiner

MULTILAYER IDENTIFICATION PATCHES

CROSS-REFERENCE TO RELATED APPLICATIONS

This application is a continuation-in-part of U.S. patent application Ser. No. 16/733,120, entitled "Modular Polyvinyl Chloride Retroreflective Identification System," which was filed on Jan. 2, 2020, which was published as United States patent application publication number 2020/0215792 on Jul. 9, 2020, and which claims the benefit of priority to U.S. provisional patent application No. 62/787,893, entitled "Modular Polyvinyl Chloride Retroreflective Identification System," which was filed on Jan. 3, 2019. The entire contents of those applications are hereby incorporated herein by reference.

TECHNICAL FIELD

The present disclosure pertains in general (a) to apparel, garments, and other devices to be worn; and in particular (b) to trimmings for garments; and more particularly (c) to patches comprising symbols to identify the wearers of the patches; and (d) to methods for manufacturing such patches.

BACKGROUND

One of the major safety concerns for tactical professionals such as military personnel, law enforcement personnel, and other first responders, is to positively identify so-called friendly operational personnel, to distinguish between those personnel and potential foes or targets.

Badges and patches for identifying personnel have been widely used for decades. According to conventional technology, an identification patch may be made by embroidering colored thread over fabric that has a contrasting color. Alternatively, an identification patch may be made by screen printing or hand printing ink onto fabric. However, such patches may be difficult to read from a distance, particularly in low light conditions. Such patches may also be relatively frail, and when they are used in the field under combat conditions, they may quickly lose integrity, due to forces such as exposure to the element, abrasion, and other types of wear and tear. For instance, a conventional identification patch may start to peel, fray, or otherwise degrade after only a short time of use in the field.

BRIEF DESCRIPTION OF THE DRAWINGS

Features and advantages of the present invention will become apparent from the appended claims, the following detailed description of one or more example embodiments, and the corresponding figures, in which:

DETAILED DESCRIPTION

Figure 1:
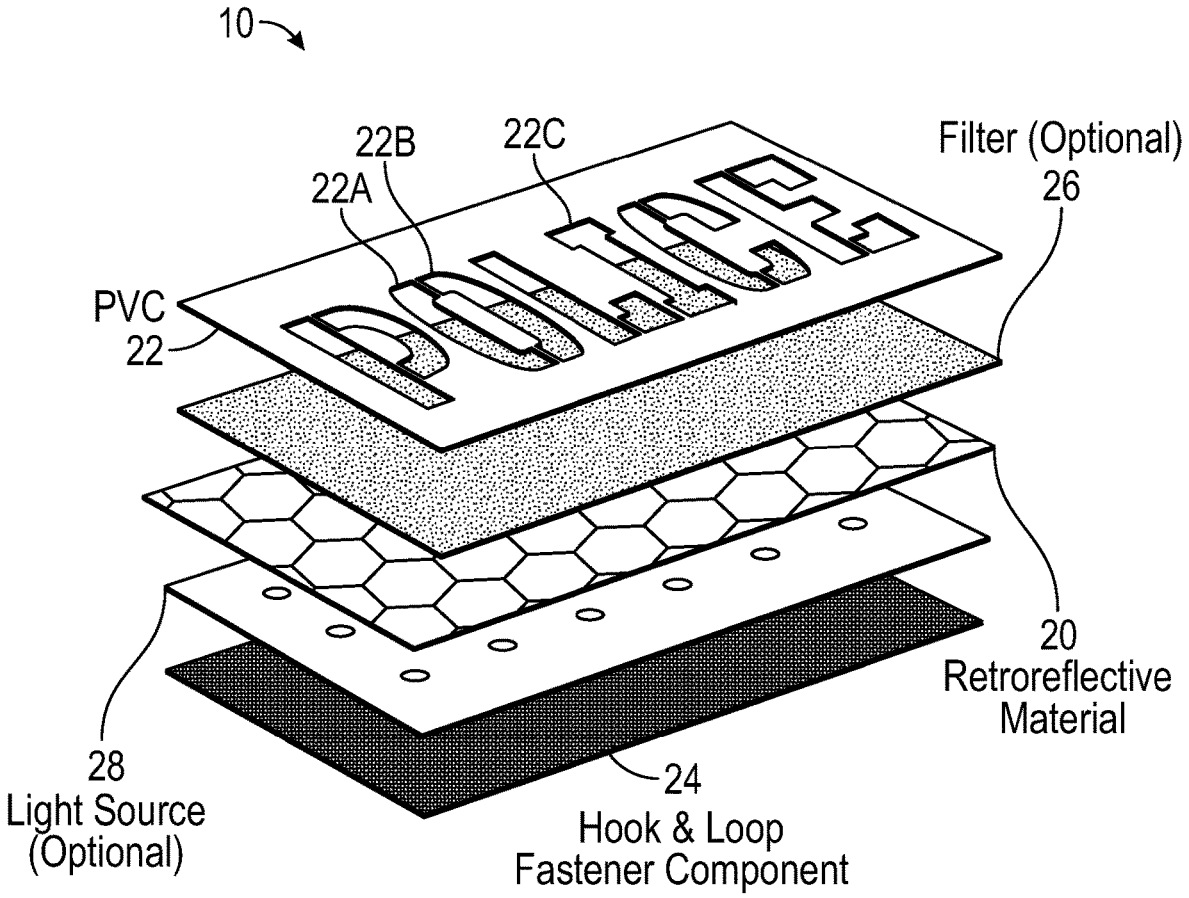
FIG. 1 is an exploded view depicting an example embodiment of a multilayer identification patch.

As suggested above, the identification of friendly forces is vastly important for tactical professionals such as operational personnel in the military and operational personnel in law enforcement. However, conventional identification (ID) patches are subject to various disadvantages, such being relatively fragile and being difficult to read from a distance, particularly in low light conditions. Also, a reflective identification patch may reflect only one type of light. For instance, an infrared (IR) reflective patch may use IR reflective material (i.e., reflective material that only reflect IR light). However, other types of conventional reflective gear (e.g., a reflective traffic vest) may only reflect visible light.

A reflective identification patch may include reflective material (e.g., reflective tape) that is completely exposed to the elements. Alternatively, a reflective identification patch can be made by screen printing ink or sewing fabric into a reflective substrate. The ink or fabric may cover some portions of the reflective substrate, while leaving other portions of the substrate exposed. For instance, the fabric may be shaped like a stencil, with holes or voids in the shape of letters, numbers, or other identification symbols. When the fabric stencil is sewn onto the substrate, some portions of the reflective substrate are covered by the fabric, while other portions are exposed via the holes in the fabric. Whether the reflective material of a patch is completely exposed, or it is partially covered by ink or fabric, the patch may lose utility over short periods of use in the field. Reflective material that is completely exposed to the elements may quickly lose integrity when used under combat conditions. In addition, screen printed ink and fabric stencils are also relatively frail, and they may quickly lose integrity when used under combat conditions. For example, the ink, the fabric, or both may fade, lose structural integrity, deform, and start falling apart after only a short period of use. Once the ink starts to degrade or the fabric stencil starts to degrade (e.g., by peeling or fraying), so do the corresponding identification symbols. Consequently, a patch with screen printed ink, with a fabric stencil, or with both may lose utility after only a short period of use. In particular, the patch may lose effectiveness with regard to the purpose of identifying the wearer.

Tactical professionals could benefit greatly from a product that is more durable than conventional ID patches and that can be worn on the uniform to allow the user or wearer to be identified by light in multiple different spectrums, such as visible light (i.e., light in the visible spectrum) and IR light (i.e., light in the IR spectrum). For purposes of this disclosure, reference to a "type" of light should be understood as denoting light from a particular spectrum or band. Thus, visible light is one type of light, and IR light is another type of light.

As described in greater detail below, the present disclosure describes ID patches which use multiple layers that provide for good visibility, good legibility, and good durability. The patches introduced by the present disclosure may be referred to in general as "advanced multilayer identification patches" (AMIPs). The present describes multiple different embodiments of AMIPs. The present disclosure also describes methods for making such AMIPs.

In one embodiment, an AMIP consists of a reflective layer in the middle, an attachment layer that is affixed to the back (or bottom) of the reflective layer, and a design layer that is affixed to the front (or top) of the reflective layer. The design layer consists of flexible polyvinyl chloride (PVC). The reflective layer consists of retroreflective (RR) sheeting material. And the attachment layer consists of a hook-and-loop fastener component. Such a patch may be referred to as a "PVC-RR-ID patch" or a "PVC-RR-ID system." For purposes of this disclosure, the term "hook-and-loop fastener" refers in general to a pair of components, which each component serving as half of the fastener. In particular, a hook-and-loop fastener include a hook half and a loop half. Typically, the hook half (or "hook component") has one side with hooks and one relatively smooth side. Similarly, the loop half (or "loop component") has one side with loops and one relatively smooth side.

In one embodiment, an AMIP (e.g., a PVC-RR-ID patch) consists of a stack of at least three layers, with a hook-and-loop fastener component as the attachment layer for the back, retroreflective sheeting material as the reflective layer in the middle, and flexible PVC as the design layer for the front, as indicated above. As indicated below, an AMIP may also include one or more intermediate layers such as a lighting layer and/or a filter layer. In one embodiment or scenario, a manufacturer creates an AMIP (e.g., a PVC-RR-ID patch) by providing or creating the components or layers separately, and then combining the layers into a final product. For instance, the manufacturer may stack and align all of the layers together and then sew or heat press the layers together to create the final product.

The design layer includes one or more voids or spaces that are shaped (individually or collectively) like identification symbols. The voids in the design layer allow light to reach and reflect from the reflective layer, while the PVC material of the design layer serves as a stencil or mask that prevents light from reaching the portions of the reflective layer that are covered by the PVC material. Accordingly, the design layer may also be referred to as a "stencil layer" or a "mask layer." Also, the voids in the design layer that allow light to reach the reflective layer may be referred to as "negative space," "mask voids," or "identification symbol voids" (ISVs). By contrast, the substance of the design layer may be referred to as the "body" of the design layer.

Many different types of design elements can be identifications symbols. For instance, an identifications symbol can be a character such as a letter or a number, a shape such as a star, a representation of an object such as an eagle, etc. In addition, an AMIP may include identification symbols which have finer details (e.g. details with higher resolution) and which are easier to see clearly, relative to conventional ID patches. An AMIP may be more visible and more legible than conventional ID patches, particularly in low light conditions. Additionally, an AMIP may be more durable than conventional ID patches. An AMIP may therefore have a longer functional life span than a conventional ID patch. As described in greater detail below, the manufacturing processes described herein enable manufacturers to create design layers that have precise shapes, including ISVs with clear, crisp, and durable edges. A manufacturer may use such a process to manufacture an AMIP with a design layer that contains ISVs with edges that are precise and intricate, yet also durable.

AMIPs may be used in the technical field of uniform accessories for military and law enforcement personnel, for instance. For example, AMIPs can be worn on the uniforms of military or law enforcement operational personnel to increase visibility of these individuals in various light conditions. AMIPs may include identification symbols that can be seen by the naked eye, and thus the general public. In addition or alternatively, AMIPs may include identification symbols that do not reflect visible light and are only visible with the aid of special equipment, which other operational personnel may use to enable those personnel to identify or distinguish friends from potential foes. In one embodiment, an AMIP is able to reflect light in the IR, visible, and the ultraviolet (UV) spectrums, and consequently can be used to identify friendly forces in various light conditions. Moreover, as indicated above, an AMIP may have enhanced durability, relative to conventional ID patches.

In one embodiment, an AMIP (e.g., a PVC-RR-ID patch) includes a reflective layer that causes the patch to reflect IR light. For purposes of this disclosure, a layer or a combination of layers that are attached or secured together may be referred to as a "module." Accordingly, a patch with a layer or a combination of layers that causes the patch to reflect IR light may also be referred to as a "modular PVC-IR system" or a "Mod-PVC-IR system."

The present disclosure describes multiple different variants or embodiments of AMIPs. Those embodiments may include, without limitation, the variants described below.

High-visibility: A high-visibility AMIP (e.g., a high-visibility Mod-PVC-IR system) allows for the wearer to be identifiable in low light conditions. High-visibility AMIPs are highly visible because they feature ISVs which are highly reflective of both normal (i.e., visible) light and of IR light, which may be seen using night vision equipment, for instance.

Covert: A covert AMIP (e.g., a covert Mod-PVC-IR system) features ISVs which are reflective of IR light, but which are only semireflective or nonreflective of regular (i.e., visible) light. Accordingly, it may be difficult or impossible for an observer to detect and read the ISVs of a covert AMIP without using special equipment that has IR sensors, especially if there is not much ambient light.

Backlit: A backlit AMIP includes a lighting layer behind the reflective layer, to facilitate identification of the wearer in low light conditions. The lighting layer includes a light source such one or more light-emitting diodes (LEDs), an interchangeable chemiluminescent device, or some other source of light. The light source may be battery powered. A backlit AMIP also includes a reflective layer that is transmissive, in that it allows light from the light source to pass through the reflective layer and shine out through the front side of the patch. The light emission from the lighting layer is able to permeate the retroreflective sheeting and illuminate the desired area (e.g., the ISVs of the patch) even when there is no external light source. By contrast, the identification symbols of a reflective-only patch may be difficult or impossible to see when there is no external light source. The ability to pass light through the reverse side of the retroreflective material, in combination with the addition of a self-contained light source, allows a backlit AMIP to provide luminescence, even in the absence of ambient light or an outside light source.

(4) Filtered: A filtered AMIP has selective filtration qualities for wavelength-specific filtration of light transference and/or reflection. For instance, a filtered AMIP may include a filter layer that blocks most or all transference and/or reflection of visible light, or a filter layer that blocks most or all transference and/or reflection of IR light.

(5) Electronically enhanced: An electronically enhanced AMIP includes one or more electronic mechanisms for identifying the wearer. Such electronic identification mechanisms may include radio-frequency identification (RFID), global position satellite (GPS) information, identification information transmitted via a short-range wireless technology such as the technology known by the name or trademark of "Bluetooth," an electronic identification mechanism to be realized on the future, etc. In one embodiment, one or more electronic identification mechanisms are included as one or more additional layers in the patch. For instance, an electronic identification mechanism may be included as an electronic enhancement layer that is positioned as the second layer, on top of the attachment layer. The electronic enhancement layer may be attached to all adjacent layers (e.g., to the attachment layer and to either the lighting layer (if included) or the reflective layer). In another embodiment, one or more electronic identification mechanisms may be connected to the patch as peripheral components.

For purposes of this disclosure, when an item is described as reflecting (or being reflective of) a certain kind of light, unless specified otherwise, it should be understood that the item reflects most or all of that kind of light when that kind of light hits the front side of the item. On the other hand, if an item is described as not reflecting (or being nonreflective, semireflective, or low reflective of) a certain kind of light, unless specified otherwise, it should be understood that the item reflects none or less than half of that kind of light, absorbing or otherwise dissipating most or all of that kind of light when that kind of light hits the front side of the item. For instance, a covert AMIP reflects most or all of the IR light that hits the ISVs on the front of the patch, but reflects less than half (e.g., none) of the visible light that hits the ISVs on the front of the patch. Similarly, when an item is described as filtering a certain kind of light, unless specified otherwise, it should be understood that the item prevents most or all of that kind of light from passing through the item. On the other hand, if an item is described as transmitting (or being transmissive of) a certain kind of light, unless specified otherwise, it should be understood that the item allows most or all of that kind of light to pass through the item. For instance, a transmissive reflective layer that transmits visible light will allow all or most of the visible light that hits the back of the transmissive reflective layer to pass through the transmissive reflective layer. Some of that light will then be blocked by the design layer, and some will shine out through the front side of the patch via the ISVs in the design layer.

AMIPs can solve several problems that exist with some or all conventional ID patches. For example, an AMIP can be made to allow the wearer to be identified in multiple types of light (e.g., visible light and IR light), rather than in just one type of light (e.g., visible light only). When worn on the uniform, an AMIP can make the wearer more safe by allowing the wearer to be seen under low light or no light conditions. For instance, if there is no ambient visible light, it may still be possible to use night vision equipment to see IR light reflected from the AMIP. And if there is some ambient visible light, it may be possible to see visible light reflected from the AMIP. Moreover, the light coming from the AMIP may be clearly legible, since it is reflected in the shape of the voids in the design layer, and those voids may be shaped to form clear and crisp identification symbols.

Also, a PVC design layer may be much more durable than cloth or embroidery.

Also, it may be possible to create a PVC design layer with design details that cannot be produced using traditional techniques like embroidery. For example, a manufacturer may give the front side or face of an AMIP finer details than can be provided by embroidery. Those details may help the public to identify the wearer, thanks to the clearer definition and the high degree of reflectivity of the AMIP. These benefits may be useful for safety personnel in emergency situations, and for public safety officials in routine traffic situations, for instance.

As described in greater detail below, one embodiment includes (a) a PVC design layer for flexible protection and detailed design, (b) a reflective layer made with retroreflective sheeting, and (c) an attachment layer made with hook-and-loop fasteners. That embodiment may be referred to as the "base system." Other embodiments may include additional layers (e.g., a filter layer, a lighting layer, and/or one or more electronic enhancement layers) that allow for even greater utility for the user. For instance, the base system can be modified to incorporate a light source behind the reflective layer. The light source may enhance the visibility of the ISVs, particularly when little or no ambient light is available.

Also, other embodiments may use a different type of design layer. For instance, in one embodiment or scenario, a manufacturer uses a UV printing process to create a design layer on top of the reflective layer. In particular, the manufacturer uses a UV printer to spray or deposit liquid photopolymer ink onto desired portions of the reflective layer, to create a mask or stencil. The photopolymer ink includes pigments, binders such as monomers and oligomers, and auxiliaries such as photoinitiators. Also, as the UV printer deposits the photopolymer ink, the UV printer shines UV light onto the deposited ink, which causes that ink to harden or cure, at least partially. In particular, when the liquid photopolymer ink is exposed to UV light, the photoinitiators cause some or all of the monomers and oligomers to transform into polymers. Accordingly, the cured material includes pigments and polymers.

For purposes of this disclosure, the term "photopolymer" may be used to refer both to (a) uncured liquid ink that contains ingredients (e.g., monomers, oligomers, and photoinitiators) which, when exposed to UV light, create polymers; and (b) cured material that contains polymers which were formed as a result of exposure to UV light.

In one embodiment or scenario, a manufacturer may use a printer such as the product sold under the brand "Compress" under the name or trademark of "iUV1200 Industrial LED UV Printer." Other printers may be used in other embodiments or scenarios.

As indicated above, in one embodiment, a manufacturer deposits a design layer directly onto a reflective layer. In another embodiment, a manufacturer deposits a design layer onto a filter layer, or onto a different layer that is (or that will be) secured on top of the reflective layer. For purposes of this disclosure, the term "onto" is used to indicate that one material or layer is deposited or affixed directly onto another material or layer, while the term "on top of" is used more generally to indicate that one material or layer is positioned (or will be positioned, upon final assembly) above another material or layer. Also, the term "above" means towards the front of the patch (which is the side that is exposed when the patch is worn by a user), and "below" (and "under") means toward the rear or back or bottom of the patch. Thus, as indicated above, a manufacturer may create a patch with a design layer "on top of" a reflective layer by depositing the design layer "onto" a filter layer that is positioned above the reflective layer.

FIG. 1 is an exploded view depicting an example embodiment of an AMIP 10 that includes five layers. However, some of those layers are optional. In other words, as described in greater detail below, other embodiments may include fewer layers than five layers.

In the embodiment of FIG. 1, AMIP 10 includes a reflective layer 20. Reflective layer 20 may be made of retroreflective sheeting, for instance. The retroreflective sheeting can be woven, printed, or otherwise created using any suitable manufacturing process. In one embodiment, reflective layer 20 is made of retroreflective material that reflects IR light, visible light, and UV light.

In some embodiments, retroreflective material is made using capsules (e.g., glass beads) or prisms (e.g., as microprisms). For instance, the manufacturer may use retroreflective material with a structure that includes a top layer of polyethylene terephthalate (PET), an intermediate layer of capsules (e.g., glass beads), and a lower reflective layer. Such material may have high strength and a service life of about ten years, for instance. In one embodiment, the reflective layer includes a hexagon pattern, like a honeycomb.

In the embodiment of FIG. 1, AMIP 10 also include a filter layer 26 that prevents one or more types of light from passing through the filter layer. Filter layer 26 thus prevents the selected type(s) of light from reaching reflective layer 20, thereby preventing AMIP 10 from reflecting that type of light. For purposes of this disclosure, an AMIP that reflects only one type of light through its ISVs may be referred to as "light-specific."

However, filter layer 26 is optional, in that other embodiments may not include a filter layer. For instance, a light-specific AMIP may use a reflective layer that reflects only a certain kind of light (e.g., IR light or visible light). Or a high-visibility AMIP may reflect multiple types of light (e.g., IR light, visible light, and UV light).

In the embodiment of FIG. 1, AMIP 10 also includes a design layer 22 which includes at least one ISV that allows light to reach reflective layer 20. In particular, the ISVs in design layer 22 form the letters "POLICE." For instance, ISVs 22A and 22B form parts of the letter "O," and ISV 22C forms the letter "I." Light may pass through design layer 22 via the ISVs, reflect off reflective layer 20, and then pass back through the ISVs, to be detectable by observers using the naked eye, or using special equipment to detect non-visible light such as IR light.

Design layer 22 may be made of flexible PVC. For instance, the manufacturer may create design layer 22 by mixing one or more PVC polymers with one or more liquid plasticizers, one or more stabilizers, and one or more dyes, and then pouring the resultant mixture into a mold with the desired shape for design layer 22. The mold causes the mixture to take the form of the desired mask, while leaving the ISVs open or empty. In one embodiment or scenario, a manufacturer creates and uses custom aluminum molds to create custom design layers with identification features that complement the uniform to which each AMIP will be affixed.

In one embodiment, the manufacturer uses a mold with multiple different strata, and the manufacturer fills each stratum with a different color of flexible PVC, to produce a design layer with multiple colors. For instance, a mold may include three strata, with the first stratum shaped to receive white PVC that forms a set of symbols to appear on the front of the design layer. The second stratum may be shaped to receive black PVC that spans the entire surface of the design layer except for the ISVs, thereby providing a black background for the symbols in the first stratum. For example, in one embodiment, the ISVs in the black PVC form the letters "U.S. MARSHALS," and the symbols (from the first stratum) which appear on the front of the design layer spell out "Fugitive Task Force" in white PVC.

The third stratum may be shaped to receive clear PVC to underlie the second stratum. The third stratum may then form the back of the design layer, to be attached to an attachment layer 24, as described in greater detail below. In addition, the shape of the third stratum may include voids to receive clear PVC that will form support structures that increase the durability of the design layer. In particular, each such support structure may span across a small portion of a void, from one edge of a symbol to another edge, to make those edges more durable. The clear support structures may enable Acme to use a single ISV to form a symbol that might otherwise need opaque connections (and consequently multiple ISVs) for sufficient durability. Accordingly, the clear support structures may enable Acme to create letters that look complete, and not look like stenciled letters.

As shown in FIG. 1, AMIP 10 also includes an attachment layer 24 to enable identification patch 10 to be secured to a wearer. In one embodiment, attachment layer 24 is one part of a hook-and-loop fastener. For instance, attachment layer 24 may be the hook component (e.g., a strip of fabric with hooks), to enable identification patch 10 to be secured to a loop component that has been sewn or otherwise attached to apparel. Alternatively, attachment layer 24 may be the loop component. In addition, an AMIP may be provided to the consumer with both components of a hook-and-loop fastener attached to the patch. In some embodiments, the attachment layer may use other types of fasteners, such as buttons or fasteners suitable for use with PALS/MOLLE. Attachment layer 24 may allow the wearer to choose the location for the patch that best fits the wearer's individual needs.

AMIP 10 also includes an illumination layer or lighting layer 28. However, in other embodiments, lighting layer 22 may be omitted. Lighting layer 28 includes a light source which allows AMIP 10 to operate as a backlit AMIP, as indicated above. In the embodiment of FIG. 1, lighting layer 28 is located behind reflective layer 20, and reflective layer 20 is transmissive, in that it allows light from the light source to pass through reflective layer 20 and shine out through the ISVs on the front side of the patch.

For ease of reference, this disclosure describes manufacturing processes as being used by a hypothetical manufacturer named "Acme."

When manufacturing AMIP 10, Acme may position filter layer 26 between, and directly adjacent to, design layer 22 and reflective layer 20. Acme may also position lighting layer 28 adjacent to the reflective layer, on the side opposite filter layer 26. As indicated above, Acme may then secure all of the layers together to form the assembled AMIP. In one embodiment, Acme affixes each layer to all adjacent layers. For instance, Acme may affix attachment layer 24 to AMIP 10 by sewing attachment layer 24 to AMIP 10 after all of the layers have been stacked together.

Alternatively, for an AMIP which includes only a design layer, a reflective layer, and an attachment layer, Acme may secure the layers together by cutting a hot melt glue sheet (e.g., with a die cutter or a laser cutter) to match the shape of the design layer and by then heat pressing the design layer to the reflective layer. For instance, Acme may use a process like the one described below with regard to block 234 of FIG. 8. At this point, the combined reflective layer and design layer may be referred to collectively as a "patch module." Acme may then sew the attachment layer to the patch module. Alternatively, Acme may also use a second hot melt glue sheet to secure the reflective layer to the attachment layer.

Alternatively, an AMIP may include a lighting layer with no attachment layer, or with an attachment layer already affixed to the lighting layer. Also, the reflective layer may include an adhesive backing. Acme may complete assembly of such an AMIP by peeling a protective film from the adhesive backing and then pressing the back of the reflective layer into the front of the lighting layer.

Figure 2:
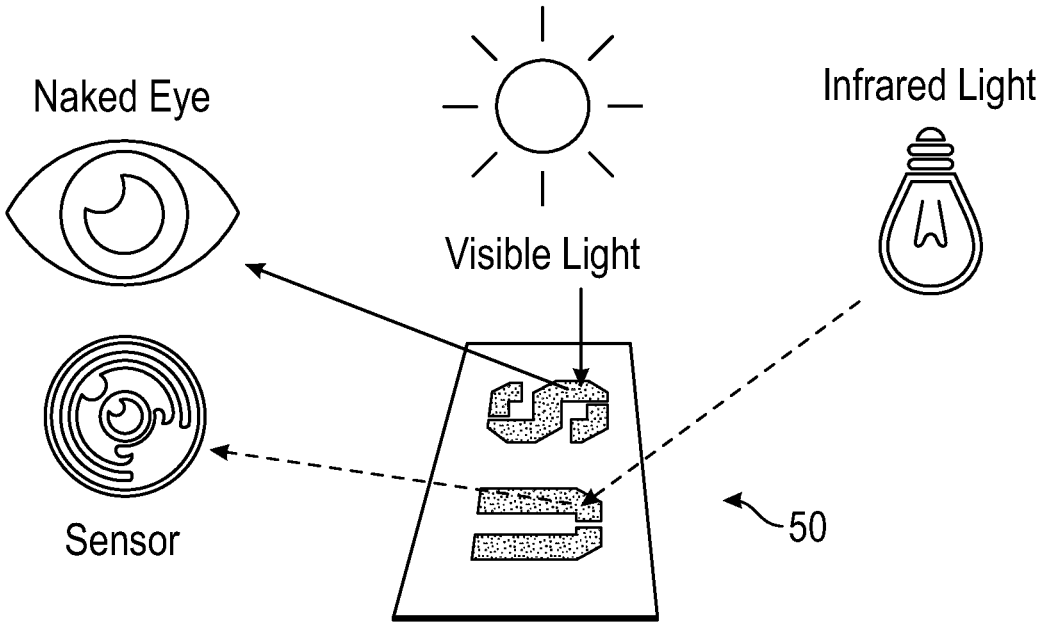
FIG. 2 is a perspective view of an example embodiment of a multilayer identification patch in an environment which illustrates visible light and infrared light reflecting from the patch.

FIG. 2 is a perspective view of an example embodiment of an AMIP 50 in an environment which illustrates visible light and IR light reflecting from (or "reflecting off") AMIP 50. Consequently, the reflected visible light may be seen with the naked eye, and the reflected IR light may be detected by or with help from a specialized sensor, such as an image intensifier.

Figure 3:
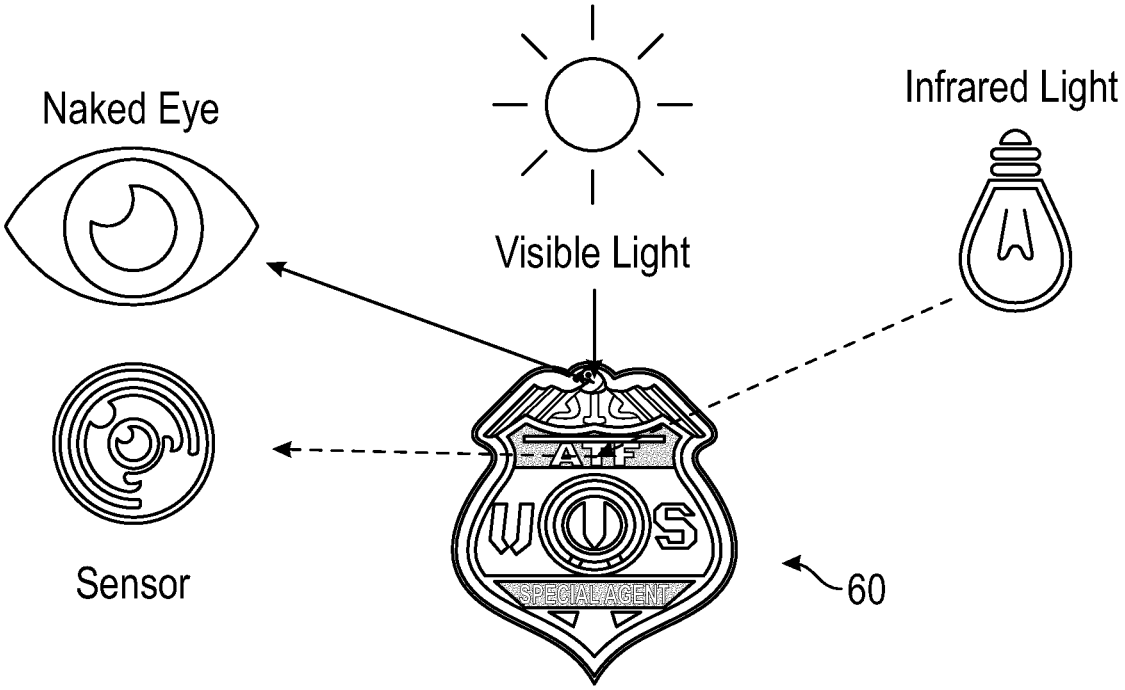
FIG. 3 is a perspective view of another example embodiment of a multilayer identification patch in an environment which illustrates visible light and infrared light reflecting from the patch.

FIG. 3 is a perspective view of example embodiment of an AMIP 60 in an environment which illustrates visible light and IR light reflecting from the AMIP 60. The design of AMIP 60 includes more details and finer details than the design of AMIP 50. In particular, in AMIP 50, the design layer only includes five ISVs: two to form the letter "U," and three to form the letter "S." By contrast, the design layer of AMIP 60 includes many more ISVs, including ISVs with finer details, smaller dimensions, etc. For instance, the design layer of AMIP 60 includes ISVs to form the letters "US," "ATF," and "SPECIAL AGENT," as well as additional ISVs to form other identification symbols, such as a representation of an eagle. Accordingly, AMIP 60 may be referred to as having an enhanced design, relative to AMIP 50. Also, since AMIP 60 is shaped like a badge and includes the kinds of symbols that one might expect to see on a badge, AMIP 60 may also be referred to as an advanced multilayer badge (AMB). In general, for purposes of this disclosure, a patch with the shape of a badge and/or with the ID symbol or symbols of a badge may also be referred to as a "badge."

Figure 4:
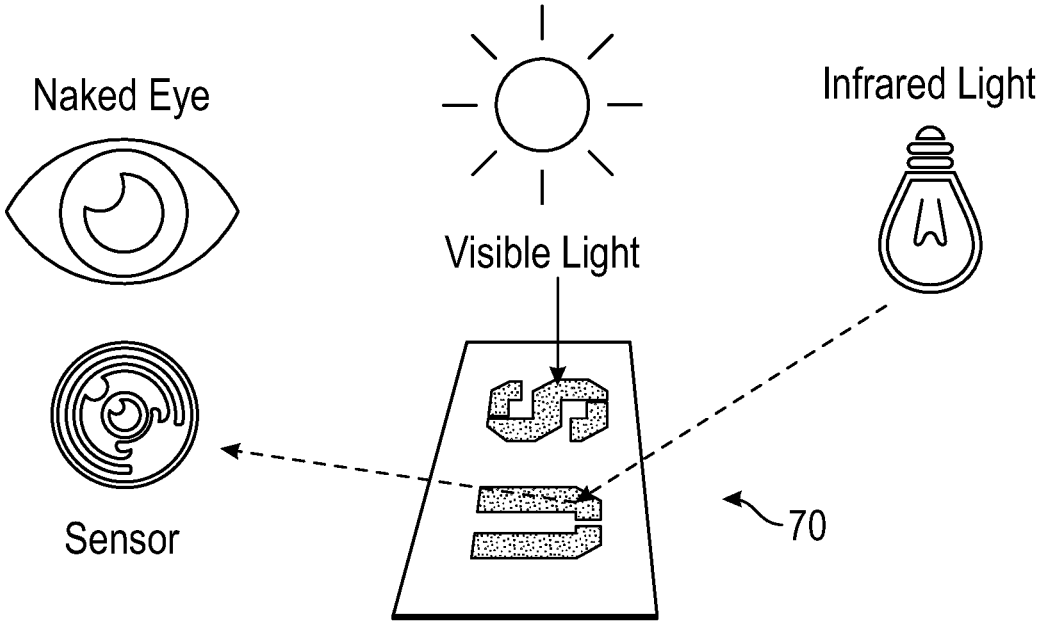
FIG. 4 is a perspective view of another example embodiment of a multilayer identification patch in an environment which illustrates only infrared light reflecting from the patch.

FIG. 4 is a perspective view of an example embodiment of an AMIP 70 in an environment which illustrates only IR light reflecting through the ISVs of AMIP 70. AMIP 70 may include a reflective layer that is designed to reflect only IR light, with no filter layer needed or used. Alternatively, AMIP 70 may include a filter layer on top of a reflective layer, with the filter layer preventing visible light from reaching the reflective layer. In either case, AMIP 70 reflects little or no visible light through the ISVs. But AMIP 70 does reflect IR light through the ISVs, and that reflected light may be detected using a suitable sensor.

Figure 5:
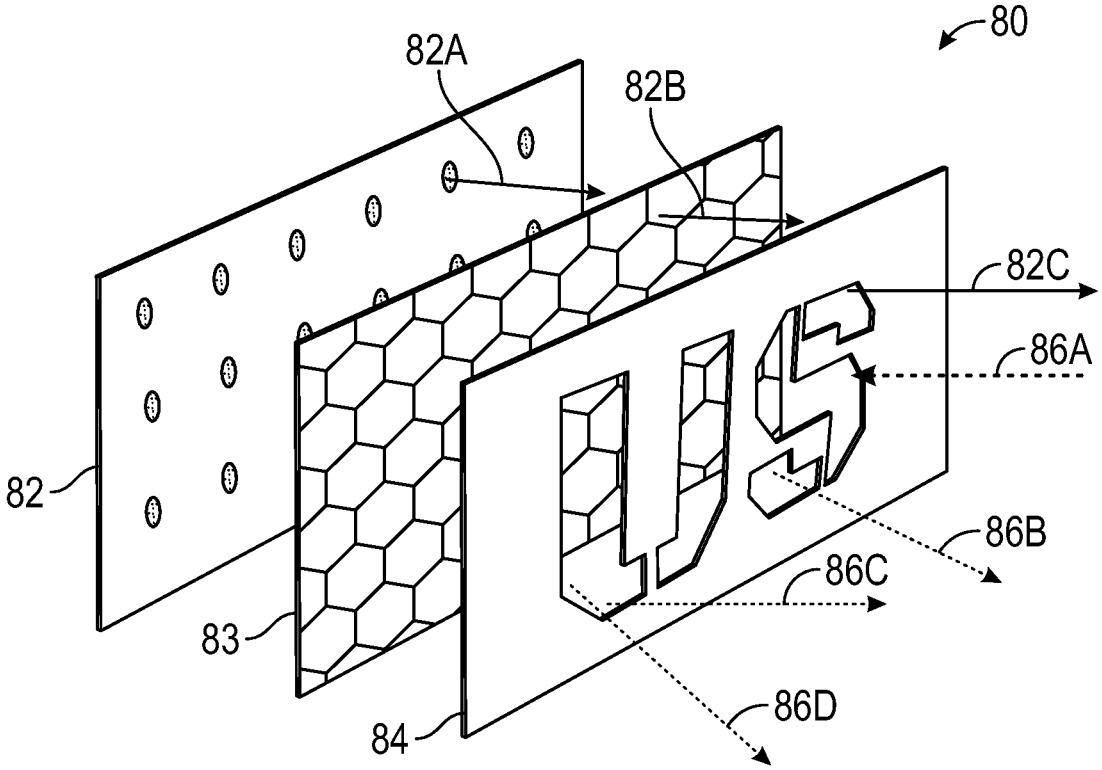
FIG. 5 is a partially exploded view depicting an example embodiment of a backlit multilayer identification patch.

FIG. 5 is a partially exploded view depicting an example embodiment of a backlit AMIP 80. Accordingly, AMIP 80 includes a lighting layer 82 that generates light, as well as a transmissive reflective layer 83 (i.e., a reflective layer that is permeable to light) and a design layer 84. Accordingly, when lighting layer 82 is generating light, that light passes through reflective layer 83 and shines out through the ISVs in the front side of the patch, as illustrated by arrows 82A-82C. In the embodiment of FIG. 5, lighting layer 82 generates visible light, and the reflective layer is permeable to visible light. Also, the reflective layer reflects IR light, visible light, and UV light ("all spectrums"). Accordingly, arrows 86A-86D in FIG. 5 show all spectrums reflecting from the exposed side (i.e., the front side) of AMIP 80.

Figure 6:
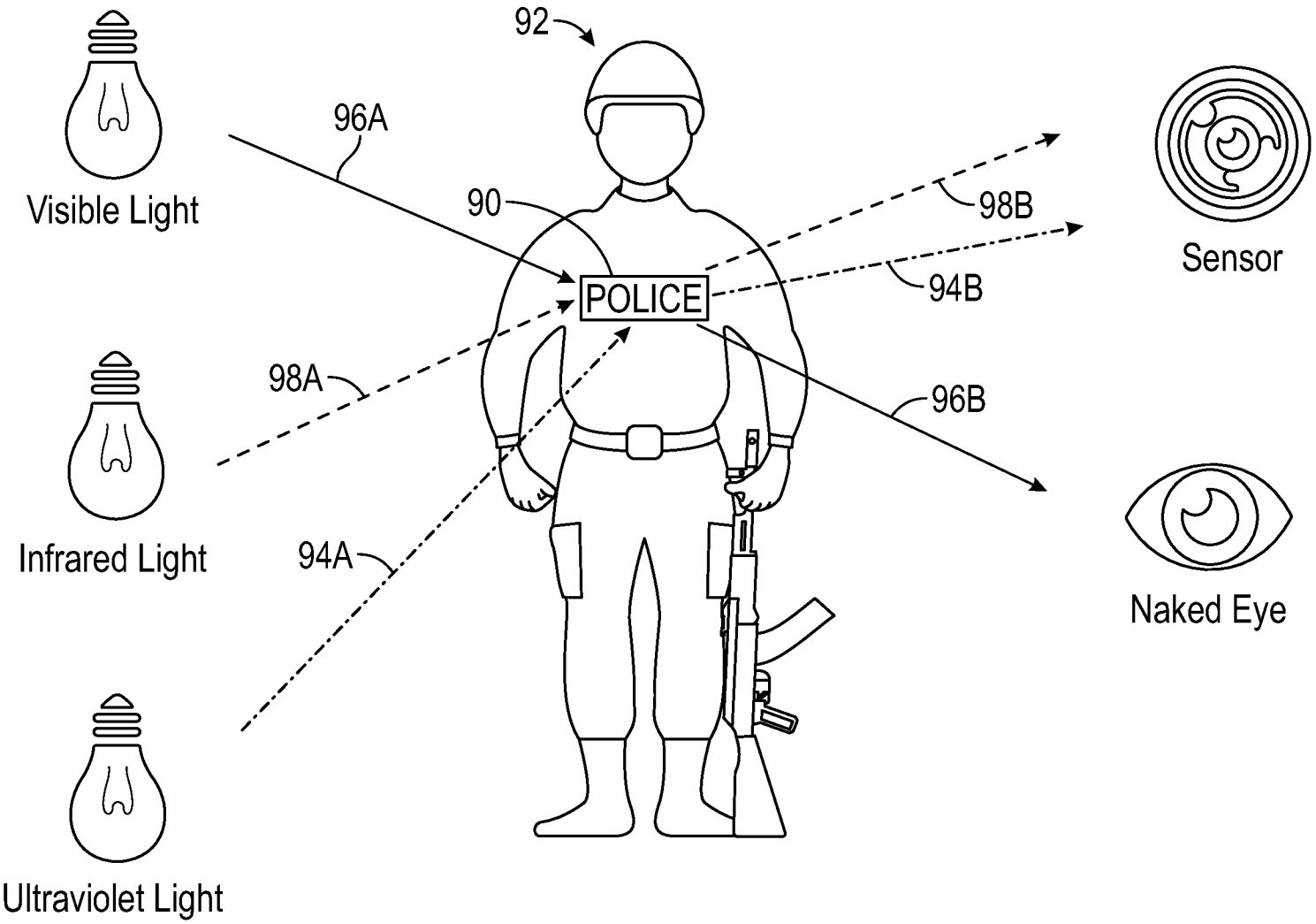
FIG. 6 is a perspective view of an example embodiment of a multilayer identification patch in use on a law enforcement officer in an environment that includes multiple light sources and multiple means of detection.

FIG. 6 is a perspective view of an example embodiment of an AMIP 90 in use on a law enforcement officer 92 in an environment that includes multiple light sources and multiple means of detection. As illustrated, AMIP 90 includes a design layer with ISVs that form the letters "POLICE," along with a reflective layer that reflects all spectrums. Additionally, the environment includes independent light sources which respectively generate IR light 94A, visible light 96A, and UV light 98A. The environment also includes a sensor that can detect IR light 94B and UV light 98B reflecting from AMIP 90. Visible light 96B may be detected reflecting from AMIP 90 by the naked eye of a human observer.

As indicated above, according to some embodiments, an AMIP includes a design layer made of flexible PVC. According to other embodiments, as indicated above, the manufacturer uses UV printing process to create the design layer for an AMIP, with the design layer made of a photopolymer.

Figure 7:
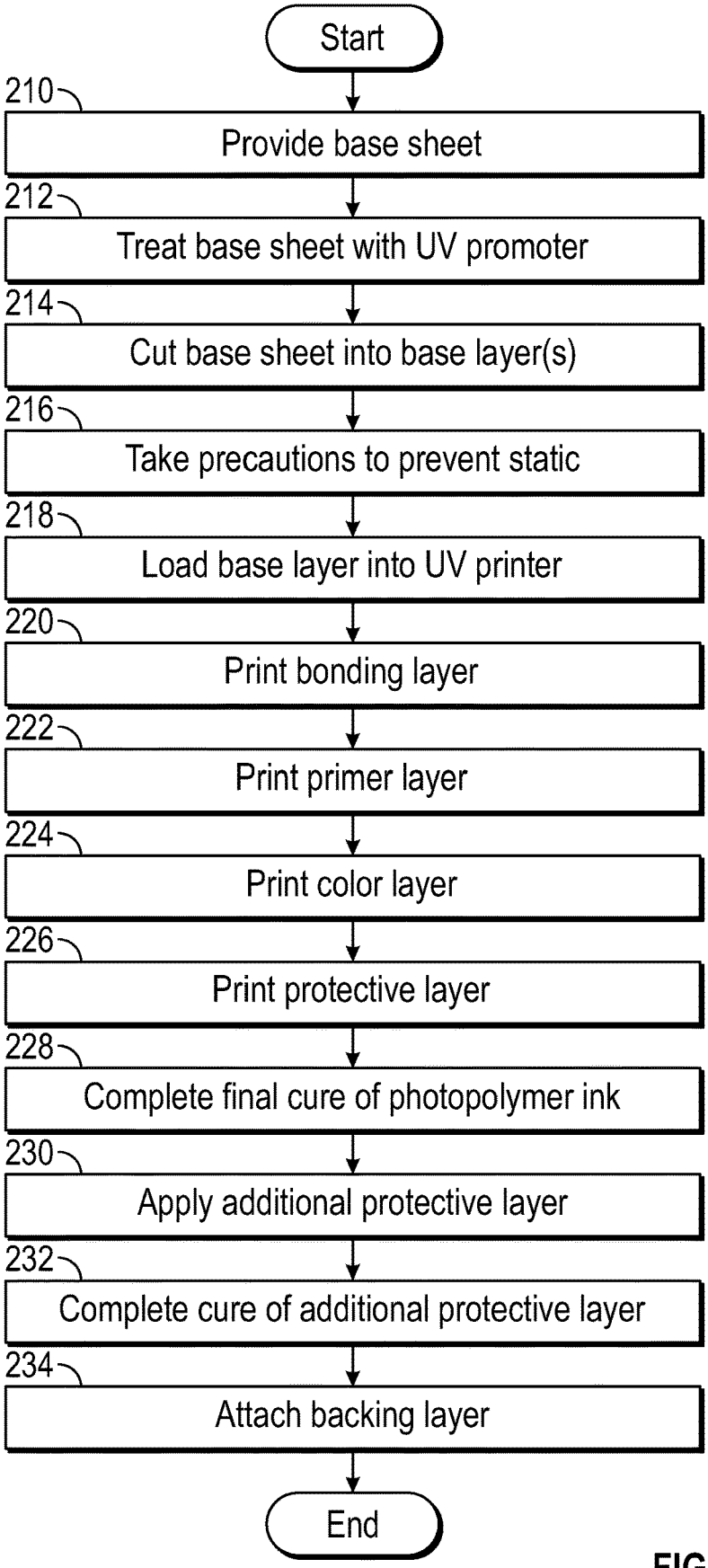
FIG. 7 is a flowchart of an example embodiment of a process for using ultraviolet printing to manufacture a multilayer identification patch.

FIG. 7 is a flowchart of an example embodiment of a process for using UV printing to manufacture an AMIP.

Figure 8:
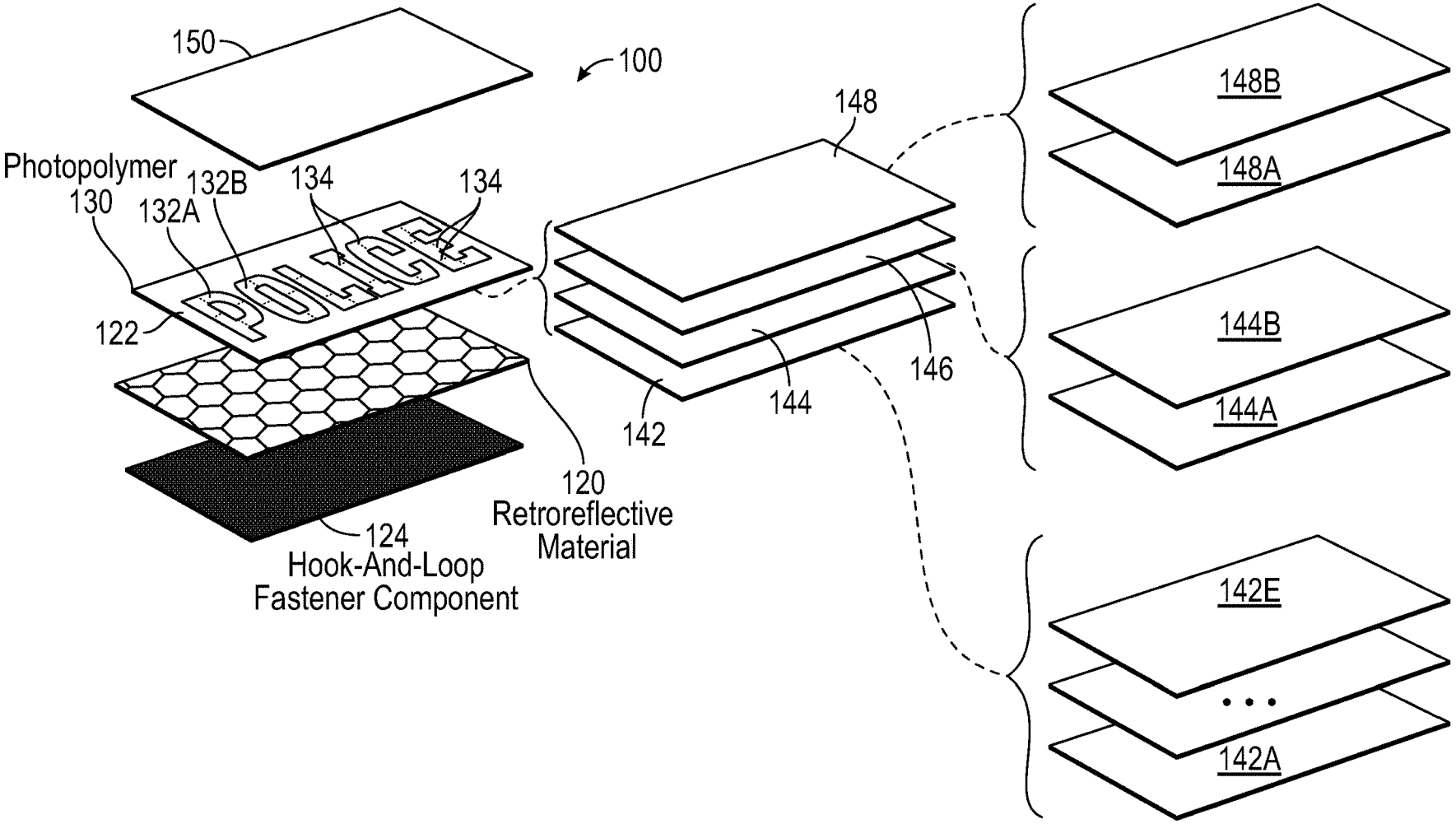
FIG. 8 is an exploded view depicting an example embodiment of a multilayer identification patch that was manufactured according to the process of FIG. 7.

Also, FIG. 8 is an exploded view depicting example embodiment of an AMIP 100 that was manufactured according to the process of FIG. 7.

Referring again to FIG. 7, the manufacturing process may start with Acme providing or selecting a large sheet of material to use as the substrate for the UV printing process, as shown at block 210. For purposes of this disclosure, the substrate may also be referred to as the "base sheet."

To make a patch with reflective symbols, Acme may use reflective material as the base sheet. Accordingly, the base sheet (or a portion thereof) will constitute the reflective layer in the finished patch. Moreover, in one embodiment, the base sheet (and thus the reflective layer) is retroreflective. In another embodiment or scenario, the base sheet is made of clear flexible PVC. The base sheet may also come with an adhesive on the backside. For example, the adhesive backing may be 50% acrylate polymer and 50% ethyl acetate. However, whether or not the base sheet includes an adhesive backing, Acme may use a distinct glue sheet to attach a layer (e.g., an attachment layer) to the back of the reflective layer, as described in greater detail below.

As shown at block 212, Acme may then apply a UV adhesion promoter to the side of the base sheet that is to be printed on. The UV adhesion promoter may cause the photopolymer ink to stick more tenaciously to the base sheet. In one embodiment, to treat the base sheet, Acme sprays or wipes the UV adhesion promoter into the desired side of the base sheet, waits for five minutes, and then wipes off any remaining UV adhesion promoter with a cloth. Acme may use the UV adhesion promoter that is sold under the name or trademark of "AP3155" by Supply55, Inc., for instance.

As shown at block 214, Acme then cuts the base sheet into one or more base layers for one or more respective AMIPs (e.g., by die cutting or laser cutting). For instance, referring again to FIG. 8, Acme has used such a base layer as the reflective layer 120 in AMIP 100. Alternatively, as described in greater detail below, Acme may wait to cut the base sheet until after the printing for the patch module has been completed, or Acme may create a base sheet by gluing a reflective sheet and at attachment sheet together, cutting one or more patch bases out of that base sheet, and then printing on top of those patch bases.

As shown at block 216, Acme then takes precautions to prevent static accumulation and static discharges, since such discharges can cause defects such as air bubbles in the printed photopolymer ink, particularly when the substrate is reflective. Those precautions may include, for instance, using antistatic mats and an antistatic fan in the printing area. The operator may also wear an antistatic lab coat and antistatic gloves.

As shown at block 218, the operator then loads the pre-treated base layer into the UV printer. Acme then uses the UV printer and photopolymer ink to create the design layer for AMIP 100 on top of the base layer.

For instance, referring again to FIG. 8, AMIP 100 is depicted with a design layer 122 that is made of photopolymer ink 130 that was deposited onto reflective layer 120 and cured by a UV printer. Accordingly, design layer 122 may be referred to as a "photopolymer design layer." As shown, the UV printer applied the ink onto certain portions of reflective layer 120 to cover or mask those portions, while leaving other portions of reflective layer 120 open to produce ISVs (e.g., ISVs 132A and 132B, which form the symbols "P" and "O," respectively).

In addition, FIG. 8 illustrates that Acme caused the UV printer to create design layer 122 by printing multiple different layers of photopolymer ink onto either the base layer or a previous layer of printed ink. Also, each of those layers serves a different primary purpose, such as binding, priming, coloring, or protecting. In the embodiment of FIG. 8, the layers are a bonding layer 142, a priming layer 144, a color layer 146, and a protective layer 148. Furthermore, the UV printer may print multiple consecutive coats or sublayers for at least one of those layers, with the UV printer using the same kind of ink for each coat within a single layer. In the embodiment of FIG. 8, bonding layer 142 is made of five coats 142A-142E of photopolymer ink, priming layer 144 is made of two coats 144A-144B, color layer 146 is made of one coat, and protective layer 148 is made of two coats 148A-148B. Thus, design layer 122 includes ten different coats of photopolymer ink.

In particular, as indicated at block 220 of FIG. 7, the UV printer may start the creation of design layer 122 by printing bonding layer 142 onto all portions of reflective layer 120 except for those portions that will be ISVs. In particular, the UV printer prints five consecutive coats 142A-142E of clear photopolymer ink to make bonding layer 142, as indicated above and as indicated in FIG. 8 by the bracket that leads to bonding layer 142 from coats 142A-142E.

According to one embodiment, when the UV printer is printing bonding layer 142, the UV printer also deposits small areas of clear photopolymer ink within ISVs to create one or more clear support structures 134. For instance, a support structure may span across a void, from one edge of a symbol to another edge. (In FIG. 8, support structures are depicted with dotted lines.) According to another embodiment, such support structures are not created. Instead, the UV printer leaves the ISVs empty.

One advantage of using clear photopolymer ink to create the bonding layer is that clear ink allows the UV curing light to shine through the ink and cure all of the coats of the bonding layer onto the base sheet with a firm bond. By contrast, an opaque ink may bond less firmly to the base sheet.

As shown at block 222, after printing with the clear photopolymer ink, the UV printer may then print priming layer 144 onto bonding layer 220, to ensure proper color appearance for color layer 146. In the embodiment of FIG. 8, Acme used two coats 144A-144B of white ink for priming layer 144, to ensure that color layer 146 would have proper coloration.

As shown at block 224 of FIG. 7, the UV printer may then print color layer 146 onto priming layer 144. Furthermore, the UV printer may create design layer 122 with multiple colors by using different colors for different portions of the color layer. For custom orders, color layer 146 may be printed using the color (or colors) that was requested by the customer. For instance, the UV printer may create a multi-color color layer 146 that includes a flag with multiple light gray stripes, multiple dark gray stripes, and one thin blue stripe.

As shown at block 226, the UV printer may then print protective layer 148 onto color layer 146, to protect all of the layers below protective layer 148. In the embodiment of FIG. 8, protective layer 148 is made of two coats 148A-148B of clear photopolymer ink. Printing of design layer 122 may then be complete. However, the printed ink may be only partially cured. For instance, the UV printer may cause the ink to become about 80% cured, and it may take time (e.g., 24 hours) for the ink to fully cure. Accordingly, as shown at block 228, Acme may wait a suitable amount of time to allow AMIP 100 to complete the final portion of the curing process.

As shown at block 230, Acme may then apply a finish layer 150 onto protective layer 148 as the final, top-most layer of design layer 122. In one embodiment, finish layer 150 is a clear single-stage paint with a matte finish that Acme sprays onto protective layer 148 to provide additional protection and reduce glossiness. For instance, Acme may spray one or more coats of a clear paint containing acrylic resin and solvents such acetone, toluene, and xylene, such as the paint provided by Rust-Oleum under SKU number 267028.

As shown at block 232, Acme may then wait for finish layer 150 to dry, which in one scenario can take up to 24 hours. Accordingly, Acme may wait for that long before starting the next step of the manufacturing process. At this point, the combined reflective layer 120, design layer 122, and finish layer 150 may be referred to collectively as a "patch module."

As shown at block 234, Acme may then secure or affix an attachment layer 124 to the patch module—in particular, to the back of reflective layer 120. For instance, Acme may insert a hot melt glue sheet between the backside of reflective layer 120 and attachment layer 124. In one embodiment, Acme uses the hook half of a hook-and-loop fastener pair as attachment layer 124, and Acme stacks the smooth side of that hook half onto the glue sheet, opposite the design layer. Once the operator has properly aligned the patch module, the glue sheet, and attachment layer 124, the operator may insert the assembly into a heat press and engage the heat press to affix the patch module to attachment layer 124, thereby completing assembly of AMIP 100. The process of FIG. 7 may then end.

Alternatively, as indicated above, Acme may cut the base sheet after the printing for the patch module has been completed. For example, in one scenario, Acme creates a patch module by adding a design layer and a finish layer to a reflective layer. Acme then secures that patch module to an attachment sheet consisting of the hook half of a hook-and-loop fastener pair. Then, Acme cuts the patch from the base sheet and the attachment sheet in one operation. In one scenario, Acme cuts the corresponding loop half of the hook-and-loop fastener pair in a separate operation.

In another embodiment or scenario, Acme first uses a hot melt glue sheet to secure a reflective sheet to an attachment sheet, then waits for the glue to cool, and then cuts the material that forms the base of a patch out of the combined base sheet and attachment sheet. For purposes of this disclosure, that material may be referred to as a "patch base." Acme may then process the patch base as described above, for instance by using a UV printer to print a design layer on top of the reflective layer, etc.

Acme may then perform finishing operations such as sanding any rough edges smooth. Acme may then deliver AMIP 100 to the customer. And Acme may also include the corresponding loop half of the hook-and-loop fastener, in case the customer's apparel does not already have a loop half of a hook-and-loop fastener attached.

In other embodiments, Acme may alter the manufacturing process. For instance, Acme may include a lighting layer between the backing layer and the reflective layer. In addition or alternatively, Acme may include a filter layer on top of the reflective layer. The filter layer may prevent the reflective layer from reflecting visible light, while allowing the reflective layer to reflect IR light, for example. For purposes of this disclosure, such a filter may be referred to as an "IR filter," and it may be used to create a covert AMIP. In one embodiment or scenario, Acme creates the filter layer by obtaining paint that, when dry, operates as an IR filter. Acme then creates the filter layer by spray one or more coats of that IR filter paint onto the reflective layer. Then, after that paint has dried, Acme may use a process like the one described above to create a design layer on top of the reflective layer and the filter layer. Alternatively, Acme may use a reflective layer that also features a filter layer that has already been secured to the reflective layer. In such a scenario, Acme may skip the step of applying UV promoter to the reflective layer.

In some embodiments, AMIPs may use structures other than hook-and-loop fasteners as the attachment layer. Such structures may include buttons, adhesives, fasteners suitable for use with the pouch attachment ladder system (PALS) and/or with modular lightweight load-carrying equipment (MOLLE), or other types of fasteners.

For purposes of this disclosure, a manufacturing process in which materials are added together to form multiple consecutive layers of structure may be referred to as "additive manufacturing." Accordingly, as has been described, additive manufacturing may be used to create AMIPs.

Furthermore, such AMIPs may have many advantages, relative to conventional ID patches. The beneficial aspects of AMIPs may include, for instance, light weight; strong durability; highly reflective symbols to provide for greater visibility and safety and for easier, more reliable identification; high resolution designs to provide for better aesthetics and easier, more reliable identification; and a wide variety of color options, including brighter colors than those used in some or all conventional ID patches. AMIPs may be better than conventional ID patches in one or more of the above aspects, and/or in other aspects.

Potential advantages of using patches with improved visibility and easier, more reliable identification include reducing the levels of stress experienced in the field by tactical professionals, who may be required to remain on high alert for extended periods of time, with constant monitoring of the environment for friendly operational personnel and for potential foes, which can be exhausting. Along the same lines, another potential advantage is to reduce or eliminate instances of misidentification of friends and foes. AMIPs may therefore help to reduce or eliminate the negative psychological and social impacts that result from the misidentification of friends and foes.

AMIPs according to the present disclosure may take many different forms and may be used for many different kinds of uses, including the forms and uses described herein, and many others. In one embodiment, a five-inch tall by eleven-inch wide AMIP with ISVs forming large letters may be affixed to body armor of a tactical professional to provide for superb visibility and easy identification. AMIPs with larger or smaller sizes and other designs may also easily be manufactured. In some embodiments or scenarios, AMIPs may be used by maritime workers, road construction workers, and other personnel in high-risk environments. For instance, AMIPs may be affixed to backpacks, tool bags, life jackets or other life preservers, tools, weapons, boats or other vehicles, or other items that would benefit from visibility and identification.

In addition, the processes described herein may be used to enable a manufacturer to make custom AMIPs according to customer requests for name badges, unit patches, etc. The described processes may enable the manufacturer to produce AMIPs with aesthetic and functional features that are not available with convention ID patches. The described processes may also enable the manufacturer to provide rapid turn-around time and reduced cost for an AMIP with better durability than would be provided by conventional ID patch.

In view of the wide variety of useful permutations that may be readily derived from the example embodiments described herein, this detailed description is intended to be illustrative only, and should not be construed as limiting the scope of coverage.

What is claimed is:

1. A multilayer identification patch comprising:
- a reflective layer; and
- a design layer on top of the reflective layer, wherein the design layer comprises:
  - an opaque body; and
  - at least one identification symbol void (ISV) to allow light to reflect from a portion of the reflective layer via the ISV;
- wherein the ISV has a shape that forms an identification symbol;
- wherein the opaque body of the design layer comprises multiple layers of cured photopolymer ink; and
- wherein the multiple layers of cured photopolymer ink comprise an opaque layer of colored photopolymer ink.

2. The multilayer identification patch according to claim 1, wherein the multiple layers of cured photopolymer ink in the design layer further comprise a layer of clear photopolymer ink under the opaque layer of colored photopolymer ink.

3. The multilayer identification patch according to claim 2, wherein the layer of clear photopolymer ink is bonded to the reflective layer.

4. The multilayer identification patch according to claim 1, wherein the multiple layers of cured photopolymer ink in the design layer comprise:
- a bonding layer of clear photopolymer ink bonded to the reflective layer;
- a layer of white photopolymer ink bonded to the bonding layer of clear photopolymer ink;
- the opaque layer of colored photopolymer ink bonded to the layer of white photopolymer ink; and
- a protective layer of clear photopolymer ink bonded to the opaque layer of colored photopolymer ink.

5. The multilayer identification patch according to claim 4, wherein the bonding layer of clear photopolymer ink comprises:
- a first layer of clear photopolymer ink bonded to the reflective layer; and a second layer of clear photopolymer ink bonded to the layer of white photopolymer ink.

6. The multilayer identification patch according to claim 1, further comprising:

a filter layer on top of the reflective layer; and wherein the multiple layers of cured photopolymer ink in the design layer comprise:

a bonding layer of clear photopolymer ink on top of the filter layer;

a layer of white photopolymer ink bonded to the bonding layer of clear photopolymer ink;

the opaque layer of colored photopolymer ink bonded to the layer of white photopolymer ink; and a protective layer of clear photopolymer ink bonded to the opaque layer of colored photopolymer ink.

7. The multilayer identification patch according to claim 1, wherein the reflective layer comprises a retroreflective material.

8. The multilayer identification patch according to claim 1, wherein the reflective layer comprises a retroreflective material that reflects visible light and infrared light.

9. The multilayer identification patch according to claim 1, further comprising an attachment layer under the reflective layer.

10. The multilayer identification patch according to claim 1, wherein at least one of the layers of cured photopolymer ink comprises multiple coats of a single kind of photopolymer ink.

11. A method for manufacturing a multilayer identification patch, the method comprising:

creating a design layer that comprises an opaque body and at least one identification symbol void (ISV); and securing the design layer on top of a reflective layer with the ISV positioned over a portion of the reflective layer to allow light to reflect from the portion of the reflective layer via the ISV;

wherein the operations of creating the design layer and securing the design layer on top of the reflective layer comprise:

loading the reflective layer into an ultraviolet (UV) printer; and using the UV printer to print the design layer on top of the reflective layer;

wherein the operation of using the UV printer to print the design layer on top of the reflective layer comprises using multiple layers of photopolymer ink to create the opaque body of the design layer; and wherein the multiple layers of photopolymer ink comprise an opaque layer of colored photopolymer ink.

12. The method according to claim 11, wherein the operation of using multiple layers of photopolymer ink to create the opaque body of the design layer comprises:

using the UV printer to print a layer of clear photopolymer ink on top of the reflective layer; and using the UV printer to print the opaque layer of colored photopolymer ink on top of the clear photopolymer ink.

13. The method according to claim 12, wherein the operation of using the UV printer to print the layer of clear photopolymer ink on top of the reflective layer comprises printing the layer of clear photopolymer ink onto the reflective layer.

14. The method according to claim 11, wherein the operation of using multiple layers of photopolymer ink to create the opaque body of the design layer comprises:

using the UV printer to print a bonding layer of clear photopolymer ink onto the reflective layer;

using the UV printer to print a layer of white photopolymer ink onto the bonding layer of clear photopolymer ink;

using the UV printer to print the opaque layer of colored photopolymer ink onto the layer of white photopolymer ink; and using the UV printer to print a protective layer of clear photopolymer ink onto the opaque layer of colored photopolymer ink.

15. The method according to claim 14, wherein:

the operation of using the UV printer to print a bonding layer of clear photopolymer ink onto the reflective layer comprises printing at least first and last layers of clear photopolymer ink within the bonding layer of clear photopolymer ink; and the operation of using the UV printer to print the layer of white photopolymer ink onto the bonding layer of clear photopolymer ink comprises printing the layer of white photopolymer ink onto the last layer of clear photopolymer ink within the bonding layer of clear photopolymer ink.

16. The method according to claim 11, wherein:

the operation of securing the design layer on top of the reflective layer comprises securing the design layer on top of a filter layer that is on top of the reflective layer; and wherein the operation of using multiple layers of photopolymer ink to create the opaque body of the design layer comprises:

using the UV printer to print a bonding layer of clear photopolymer ink onto the filter layer;

using the UV printer to print a layer of white photopolymer ink onto the bonding layer of clear photopolymer ink;

using the UV printer to print the opaque layer of colored photopolymer ink onto the layer of white photopolymer ink; and using the UV printer to print a protective layer of clear photopolymer ink onto the opaque layer of colored photopolymer ink.

17. The method according to claim 11, wherein the reflective layer comprises a retroreflective material.

18. The method according to claim 11, wherein the reflective layer comprises a retroreflective material that reflect visible light and infrared light.

19. The method according to claim 11, further comprising:

securing an attachment layer under the reflective layer.

20. The method according to claim 11, wherein the operation using multiple layers of photopolymer ink to create the opaque body of the design layer comprises:

using the UV printer to print multiple coats of a single kind of photopolymer ink for at least one of the layers of photopolymer ink in the design layer.

* * * * *